US006745782B2

(12) United States Patent
Mooney

(10) Patent No.: US 6,745,782 B2
(45) Date of Patent: Jun. 8, 2004

(54) SYSTEMS AND METHODS FOR CLEANING OXYGEN LINES

(75) Inventor: Joseph E. Mooney, Lusby, MD (US)

(73) Assignee: C.H.O.C.S., Inc., California, MD (US)

( * ) Notice: Subject to any disclaimer, the term of this patent is extended or adjusted under 35 U.S.C. 154(b) by 0 days.

(21) Appl. No.: 10/068,862

(22) Filed: Feb. 11, 2002

(65) Prior Publication Data

US 2002/0092545 A1 Jul. 18, 2002

Related U.S. Application Data

(62) Division of application No. 09/584,790, filed on Jun. 1, 2000, now abandoned.

(51) Int. Cl.[7] ..... B08B 9/02
(52) U.S. Cl. ..... 134/22.13; 134/10; 134/29
(58) Field of Search ..... 134/22.13, 22.1, 134/22.11, 22.12, 22.14, 18, 22.19, 26, 29, 10; 510/108, 109, 405, 511

(56) References Cited

U.S. PATENT DOCUMENTS

| | | | | |
|---|---|---|---|---|
| 774,461 | A | | 11/1904 | Wolf |
| 2,187,413 | A | | 1/1940 | Boezi et al. |
| 2,222,516 | A | | 11/1940 | Powell et al. |
| 3,128,779 | A | | 4/1964 | Morris |
| 3,139,238 | A | | 6/1964 | Norstrud et al. |
| 3,431,145 | A | | 3/1969 | Riley |
| 3,537,897 | A | | 11/1970 | Kington |
| 4,059,123 | A | | 11/1977 | Bartos et al. |
| 4,284,599 | A | | 8/1981 | Anderson et al. |
| 4,828,796 | A | | 5/1989 | Shishkin et al. |
| 4,991,608 | A | | 2/1991 | Schweiger |
| 5,039,349 | A | | 8/1991 | Schoeppel |
| 5,076,856 | A | | 12/1991 | Schweiger |
| 5,147,613 | A | | 9/1992 | Heilmann et al. |
| 5,311,892 | A | | 5/1994 | Adelt et al. |
| 5,415,190 | A | | 5/1995 | Inescu |
| 5,476,593 | A | | 12/1995 | Christ et al. |
| 5,511,568 | A | | 4/1996 | Bowman et al. |
| 5,527,395 | A | | 6/1996 | Perry et al. |
| 5,680,877 | A | | 10/1997 | Edstrand et al. |
| 5,699,817 | A | * | 12/1997 | Bankert et al. ..... 134/102.2 |
| 5,702,536 | A | | 12/1997 | Carruth |
| 5,845,684 | A | | 12/1998 | Fletcher, Jr. et al. |
| 5,858,305 | A | | 1/1999 | Malchesky |
| 5,901,719 | A | | 5/1999 | Garcia Martinez |
| 5,921,256 | A | | 7/1999 | Barin |
| 5,937,875 | A | * | 8/1999 | Nygren ..... 134/22.11 |
| 6,047,714 | A | | 4/2000 | Akazawa |
| 6,161,557 | A | | 12/2000 | Wakabayashi |
| 6,450,182 | B2 | * | 9/2002 | Fillipi et al. ..... 134/22.1 |
| 6,523,556 | B2 | * | 2/2003 | Abad et al. ..... 134/166 C |

* cited by examiner

*Primary Examiner*—Alexander Markoff
*Assistant Examiner*—Saeed Chaudhry
(74) *Attorney, Agent, or Firm*—Mattingly, Stanger & Malur, P.C.

(57) ABSTRACT

A portable apparatus cleans a passage such as an oxygen line by circulating a cleaning medium, such as a silicated alkaline cleaner such as OCC, through the passage. A rinse medium, such as distilled water, may than be circulated through the passage. The cleaning medium and the rinse medium may be filtered, and a flush medium is preferably circulated through the passage after the circulation of the cleaning medium and before the circulation of the rinse medium.

4 Claims, 7 Drawing Sheets

SYSTEMS AND METHODS FOR CLEANING OXYGEN LINES

This is a divisional application of U.S. Ser. No. 09/584,790, filed Jun. 1, 2000 now Abandoned.

BACKGROUND OF THE INVENTION

1. Field of Invention

This invention relates to systems and methods for cleaning oxygen lines.

2. Description of Related Art

Oxygen lines are used in many applications, such as in aircraft, submarines, medical facilities and the like. These oxygen lines must be clean, since they carry oxygen that will be breathed by humans. If the lines become contaminated for any reason, they must be cleaned prior to further use.

Currently, oxygen lines are taken to a cleaning laboratory, such as the Naval Oxygen Cleaning Laboratory located at Indian Head, Maryland, for cleaning. A large, freon-based cleaning system is set up at these laboratories, which is set up in a building and not easily moved. For example, this system includes large tanks used for cleaning medium recovery procedures. For safety reasons, these tanks are located outside of the building and accessed by pipes leading from the inside of the building to the outside of the building. The system also requires clean rooms, which are located in the building. Additionally, distilling equipment for handling the freon is required as part of the system, and this distilling equipment is bulky and includes vapor recovery vents and the like.

Moreover, there are relatively few such laboratories, and due to backlogs, the entire cleaning process can take from several days to more than a month. Moreover, since these laboratories are operated by the military, oxygen line cleaning jobs for the military are often given priority over civilian jobs. Thus it is inconvenient and time consuming to have oxygen lines cleaned in such a manner.

Furthermore, the system used by these laboratories passes freon-based cleaner through the oxygen lines to clean them. It is attempted to re-use the freon by boiling the freon to remove contaminants. However, much of the freon is lost during the boiling process, which results in a relatively large amount of freon waste each time a line is cleaned. For example, to clean a single oxygen line, 10 gallons of freon are typically used, but only about 3 gallons of reusable freon are recovered. Moreover, freon is considered to not be an environmentally friendly substance, and disposal of the contaminated freon is problematic.

Others have attempted to invent a non-freon-based, portable system, but have failed.

SUMMARY OF THE INVENTION

The inventor has discovered how to make a more accessible, economical and environmentally friendly oxygen line cleaning device. An oxygen line cleaning device according to this invention uses a silicated alkaline cleaner, such as Oxygen Cleaning Compound (OCC), manufactured by Octagon Process Inc. in Edgewater, N.J. The cleaner is passed through an oxygen line, and may then be filtered to remove contaminants and recirculated through the oxygen line or otherwise reused.

OCC is considered to be an environmentally friendly product, and thus disposal and handling is much easier than with the conventional freon-based cleaner. The Navy currently uses OCC (a.k.a. NOC) as a parts cleaner because it is safe and stable and may be taken aboard submarines and the like. However, the Navy has not used OCC to clean oxygen lines.

The inventor has discovered that, by cleaning oxygen lines with OCC, oxygen lines can be cleaned to a purity of about 98% or more. The above-described conventional process only achieves a purity of about 87%–93%.

Additionally, in contrast to the conventional system which requires large, expensive equipment typically available only in a specialized cleaning laboratory, this invention may be implemented in a compact, portable, relatively inexpensive device that is easily transported to a location convenient to a user.

BRIEF DESCRIPTION OF THE DRAWINGS

The invention is described in detail with reference to the following figures, wherein like numerals reference like elements, and wherein.

DETAILED DESCRIPTION OF PREFERRED EMBODIMENTS

Figure 1:
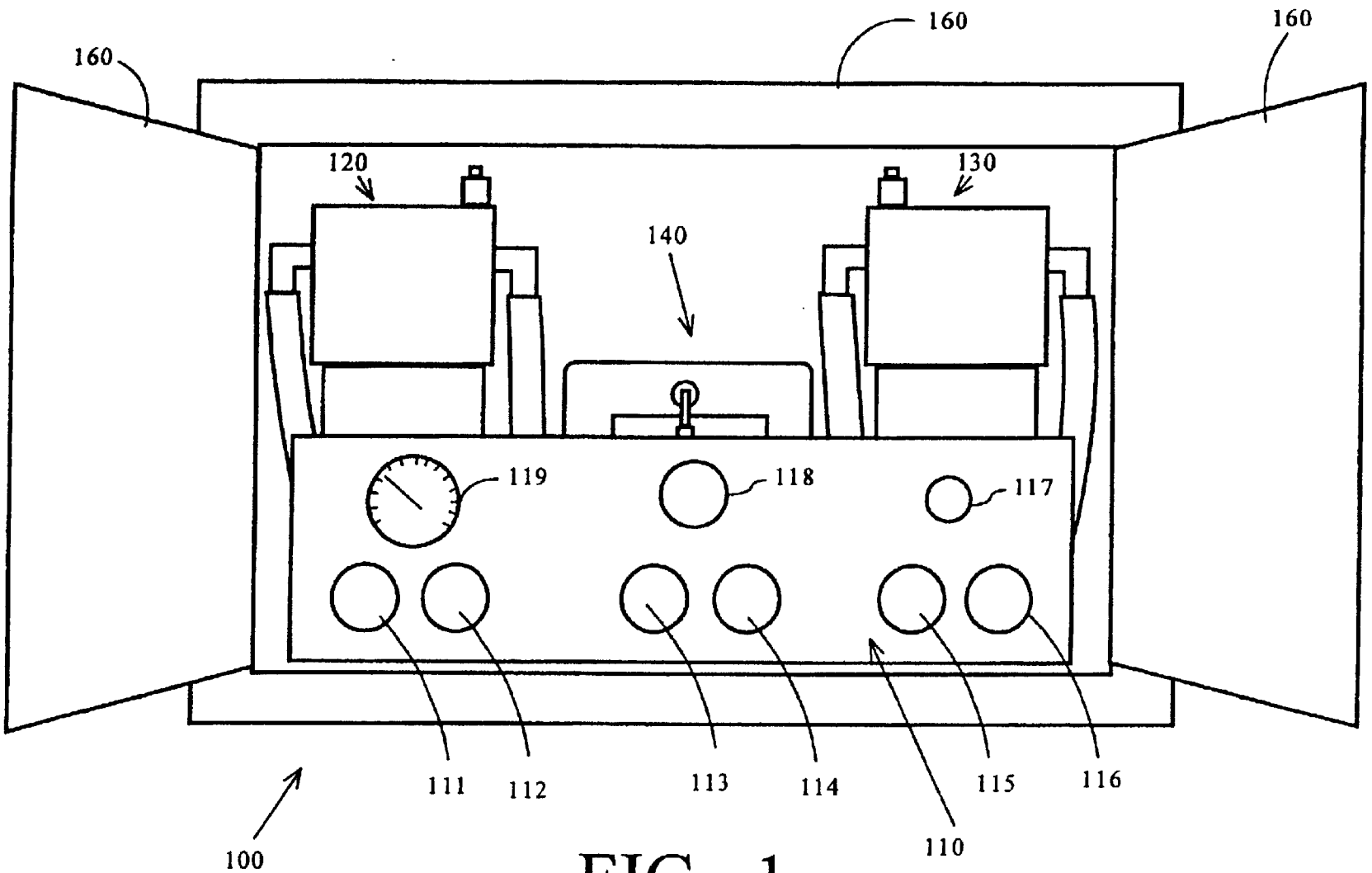
FIG. 1 shows a front view of an oxygen line cleaning apparatus in an open state.

FIG. 1 shows a front view of an oxygen line cleaning apparatus 100. A housing 150 of the oxygen line cleaning apparatus 100 has a front opening that is selectively openable/closable by doors 160. The housing 160 accommodates a connection panel 110, filters 120 and 130, and a pump 140. The pump 140 may be powered by forced air or by an electric motor, for example.

The connection panel 110 includes a cleaning medium filter inlet connection device 111, a cleaning medium filter outlet connection device 112, a pump inlet connection device 113, a pump outlet connection device 114, a rinse medium filter inlet connection device 115 and a rinse medium filter outlet connection device 116. When the pump 140 is an air-powered pump, the connection panel 110 also may include an air supply connection device 117, an air pressure regulator operating device 118, such as a rotatable knob or the like, and an air pressure gauge 119.

The connection devices 111–117 may be quick-connect couplings to facilitate connection with hoses, oxygen lines or the like, described in more detail below.

In FIG. 1, the filter connection devices 111, 112, 115 and 116, the pump connection devices 113 and 114, the air supply connection device 117, the air pressure regulator operating device 118 and the air pressure gauge 119 are shown to be located on a single connection panel 110. However, if desired, one or more of these devices may be positioned on a location other than the connection panel 110. For example, the air supply connection device 117 and/or one or more of the filter connection devices 111, 112, 115 and 116 may be positioned on a side panel of the housing 150.

Figure 2:
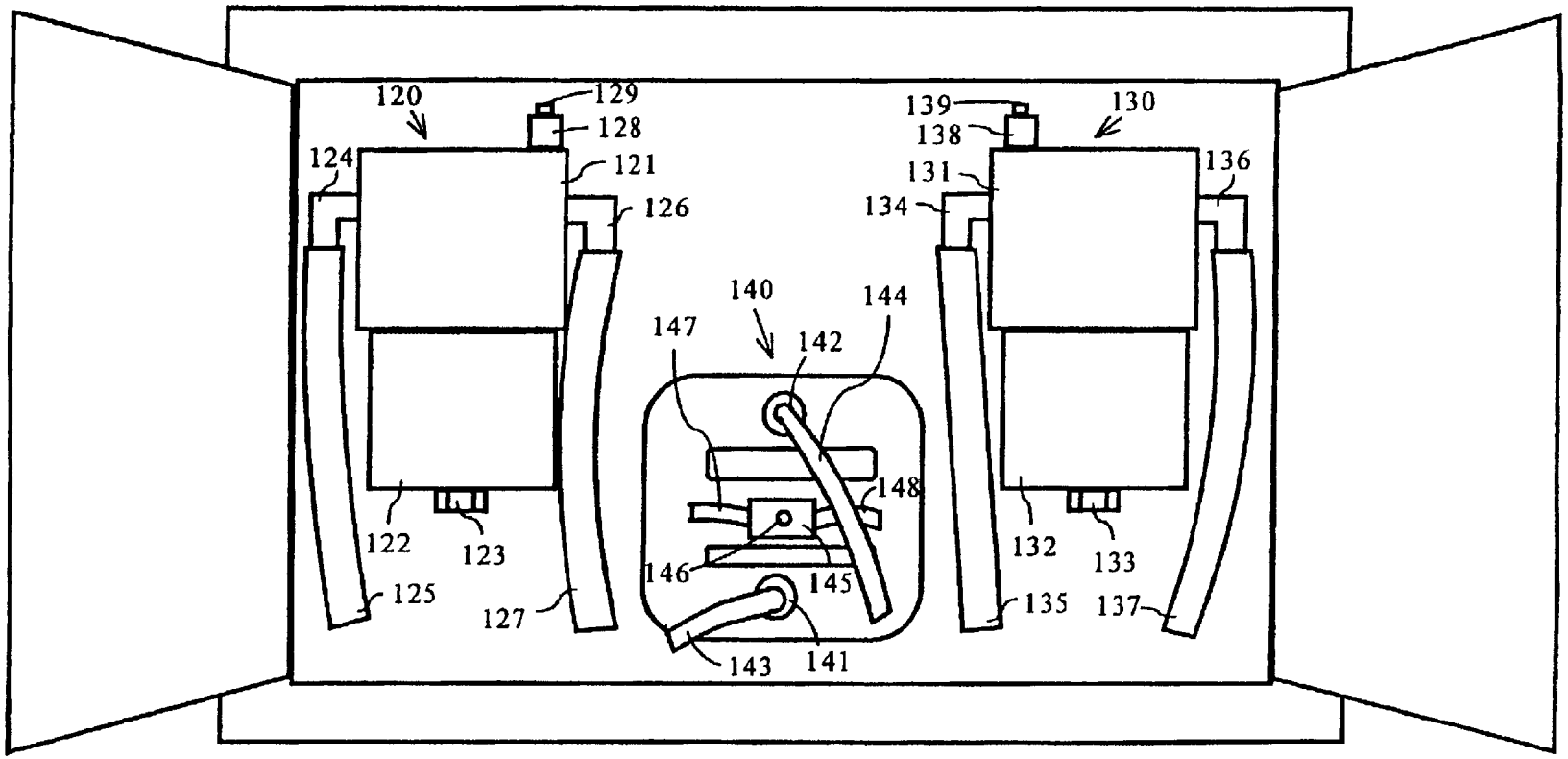
FIG. 2 shows a front view of the oxygen line cleaning apparatus of FIG. 1 with a connection panel removed.

FIG. 2 shows a front view of the oxygen line cleaning apparatus 100 with the connection panel 110 removed for a more complete view of the filters 120 and 130 and the pump 140.

The filter 120 filters a cleaning medium, as will be discussed in more detail below. The filter 120 includes a filter head 121, a filter bowl 122, a drain plug 123, an inlet 124, an inlet connection line 125 coupled to the inlet 124, an outlet 126, and an outlet connection line 127 coupled to the outlet 126. The filter 120 may also include a detection/indication unit 128, which detects when the filter needs to be cleaned or replaced, and an indicator 129. The indicator 129 may, for example, be an LED lamp, pop-up button or the like that gives an indication when the detection/indication unit 128 detects that the filter 120 needs to be cleaned or replaced. The filter 120 is preferably a bypass filter that allows the cleaning medium to bypass without being filtered when a certain backpressure, for example 50 psi, is reached at the inlet side of the filter 120. This prevents circulation through the system from slowing and/or totally stopping when the filter 120 becomes clogged.

The filter 120 preferably filters all particles of 2 microns ($\mu$m) or larger, and should be able to handle temperatures of at least up to 150° F., and volumes of at least up to 35 gallons per minute (gpm), for the following reasons. First, to increase the cleaning effectiveness, the silicated alkaline cleaner used with this invention should be heated, and is preferably heated to at least about 110° F., and more preferably about 130° F. However, it is preferable to not heat the cleaning medium to more than 150° F., since the oxygen lines may be damaged if heated too much and/or for too long. Thus, it should suffice if the filter 120 is able to handle temperatures of up to about 150°. Second, a typical maximum size of oxygen lines is about 1" (inside diameter), and to clean this size of oxygen line it is desirable to circulate about 35 gpm of cleaner through the oxygen line. Thus, a maximum filter capacity of 35 gpm should be sufficient.

The filter 120 should be made of materials capable of withstanding a caustic effect of the cleaner. Materials that have proven to be suitable include carbon steel (for the filter bowl 122) and anodized aluminum (for the filter head 121). An example of a suitable filter is a filter made by Norman Filters of Bridgeview, Ill., part number 30MF 116N-2MK-V50-R50-DR2.

The filter 130 filters a rinse medium, as will be discussed in more detail below. The filter 130 includes a filter head 131, a filter bowl 132, a drain plug 133, an inlet 134, an inlet connection line 135, an outlet 136, an outlet connection line 137, a detection/indication unit 138 and an indicator 139. The structure and function of these elements is similar to that of the corresponding elements of the filter 120, described above, so further description is omitted.

The pump 140 should have a capacity of about 35 gpm when the oxygen cleaning apparatus 100 is to be used with oxygen lines up to 1" in inside diameter. If the cleaning apparatus 100 is to be used only with smaller oxygen lines, it will be appreciated that a pump with a smaller capacity may be used. As stated above, the pump may be driven by forced air or by an electric motor. The pump 140 should be made of materials that are able to withstand a caustic effect of the cleaner. Materials that have proven to be suitable include aluminum, stainless steel and cast iron. An example of a suitable pump is a diaphragm pump made by ARO, model number 666102-322-C.

The pump 140 may include a pump inlet 141, a pump outlet 142, a pump inlet connection line 143 coupled to the pump inlet 141, a pump outlet connection line 144 coupled to the pump outlet 142, a pressure regulator 145, a regulator valve stem 146 connected to a valve of the regulator 145, a pressure gauge connection line 147 and an air inlet line 148 that passes into the pressure regulator 145.

The inlet connection line 125 of the filter 120 is coupled to a rear side of the cleaning medium filter inlet connection device 111 (FIG. 1), behind the connection panel 110, and the outlet connection line 127 is coupled to a rear side of the cleaning medium filter outlet connection device 112. Similarly, the inlet connection line 135 of the filter 130 is coupled to a rear side of the rinse medium filter inlet connection device 115, and the outlet connection line 137 is coupled to a rear side of the rinse medium filter outlet connection device 116. Furthermore, the pump inlet connection line 143 is coupled to a rear side of the pump inlet connection device 113, and the pump outlet connection line 144 is coupled to a rear side of the pump outlet connection device 114. Thus, the inlet and outlet sides of the filters 120 and 130 and the pump 140 can be accessed via the connection devices 111–116 mounted in the connection panel 110.

The connection lines 125, 127, 135, 137, 143 and 144 may be made of any suitable material. For example, metallic material, such as steel tubing or stainless steel tubing, or teflon tubing, such as teflon braided line (e.g., teflon tubing covered with a braided covering), may be used. However, from a durability standpoint, at least the pump inlet and outlet lines 143 and 144 are preferably made of stainless steel. This is because these lines are continually alternately exposed to cleaning medium and rinse medium, and this alternating exposure, coupled with partial draining and brief exposure to the atmosphere during a flush cycle, described below, is particularly hard on these lines. In particular, the pump outlet 144, which is on top, is subjected to relatively harsh conditions.

The regulator valve stem is 146 connected to the air pressure regulator operating device 118 so that, by operating the air pressure regulator operating device 118 (e.g., turning the knob), the air pressure to the pump may be controlled. The pressure gauge connection line 147 is connected to the air pressure gauge 119 so that the air pressure to the pump 140 may be indicated, and the air inlet line 148 is connected to a rear side of the air supply connection device 117.

The housing 150 may have one or more interior panels (not shown) that separate the interior of the housing 150 into two or more compartments. For example, an interior panel may be positioned behind the filter 120 and 130 and the pump 140, and one or more of the above-described connection lines may be routed behind the panel for safety and/or to improve the appearance of the oxygen cleaning apparatus 100.

Figure 3:
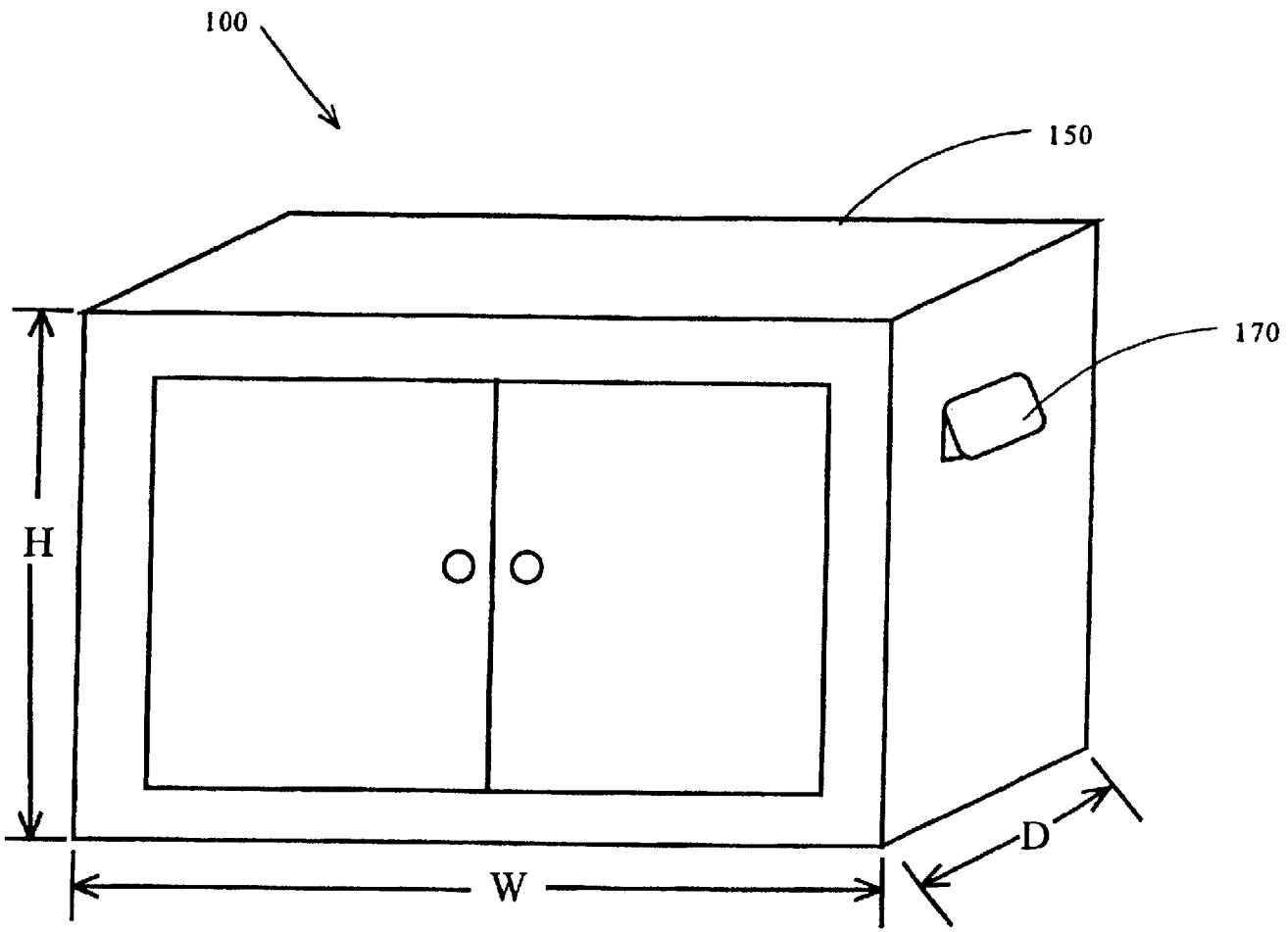
FIG. 3 shows a perspective view of the oxygen line cleaning apparatus of FIG. 1 in a closed state.

FIG. 3 shows a perspective view of the oxygen line cleaning apparatus 100 in a closed state, and shows that handles 170 may be attached to the housing 150 for carrying the oxygen line cleaning apparatus 100. The outer dimensions of the housing 150 should be kept as small as possible to enhance portability of the oxygen line cleaning apparatus 100, and to allow the oxygen line cleaning apparatus 100 to pass easily through relatively small openings, such as hatches on a submarine, for example. Thus, at least two dimensions of the oxygen line cleaning apparatus 100 should be no greater than about 36". Preferably, at least two dimensions (H, W or D in FIG. 3) of the oxygen line cleaning apparatus 100 are no greater than about 24". Even more preferably, no dimension of the oxygen line cleaning apparatus 100 is greater than about 24". For example, a housing 150 with a height dimension H of 22", a width dimension W of about 22" and a depth dimension D of about 14" will suitably accommodate the above-described pump 140, connection panel 110 and filters 120 and 130. Thus the oxygen line cleaning apparatus 100 occupies a space of only about 2 cubic feet, and may easily fit on a countertop, workbench or the like.

Additionally, the oxygen line cleaning apparatus 100 should have a weight of no more than about 150 lbs. so that no more than two people are required to carry it. The oxygen line cleaning apparatus 100 preferably has a weight of no more than about 100 lbs. Using the above-mentioned exemplary filters and pump, it is possible for the oxygen line cleaning apparatus 100 to have a weight of about 65 lbs or less.

Figure 4:
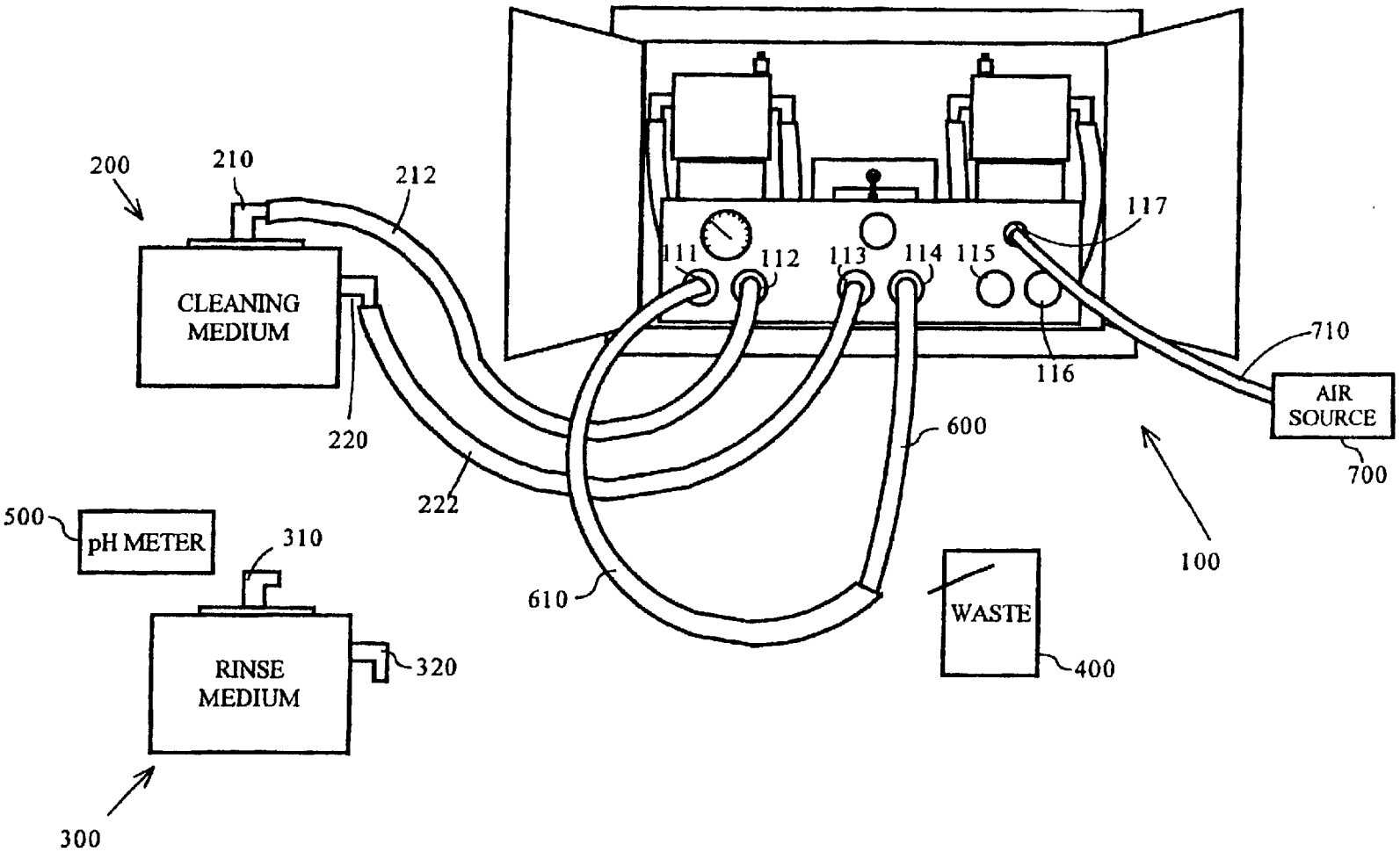
FIG. 4 shows an oxygen line cleaning system using the oxygen line cleaning apparatus of FIG. 1.

FIG. 4 shows an oxygen line cleaning system using the oxygen line cleaning apparatus 100. In FIG. 4, the oxygen line cleaning apparatus 100 is coupled to a cleaning medium tank 200 and to an oxygen line 600 that is to be cleaned. More specifically, a tank outlet 220 of the cleaning medium tank 200 is connected to the pump inlet connection device 113 via a connection hose 222, and a tank inlet 210 of the cleaning medium tank 200 is connected to the cleaning medium filter outlet connection device 112 via a connection hose 212. One end of the oxygen line 600 to be cleaned is connected to the pump outlet connection device 114, and the other end of the oxygen line 600 is connected to the cleaning medium filter inlet connection device 111. A connection hose 610 may be provided, if necessary or desirable, between the oxygen line 600 and the cleaning medium filter inlet connection device 111. Suitable adapters, such as reducing couplings or the like, may be provided to connect different sizes of oxygen line to the oxygen line cleaning apparatus 100.

The cleaning medium tank 200 preferably includes a heating device (not shown) that heats the cleaning medium. The cleaning medium should be heated to from about 100° F. to about 150° F., and more preferably to about 130° F. The cleaning medium tank 200 may also include an agitating device, such as an ultrasonic wave generator or the like (not shown). Although not necessary in the context of this invention, an agitating device allows the cleaning medium tank 200 to serve a dual purpose as an agitation-type parts cleaning tank. The cleaning medium tank 200 preferably holds two gallons or more of cleaning medium. This is because, in a system that uses the above-described pump and filters, about two gallons of cleaning medium is typically needed, although slightly less cleaning medium, such as about 1.9 gallons, will also suffice. If only smaller sizes of oxygen lines are to be cleaned and a smaller pump and smaller filters are used, an even smaller size should be possible for the cleaning medium tank 200. Very large tanks are not convenient to handle, and thus the cleaning medium tank 200 is preferably not larger than about fifty-five gallons, and more preferably not larger than about ten gallons, and even more preferably not larger than about five gallons.

The cleaning medium should be or include a silicated alkaline cleaner, such as the above-mentioned OCC. The OCC may be diluted by a dilutant, such as water (preferably distilled water), at a ratio of, for example, about one part OCC to one part dilutant.

An air source 700, such as an air compressor or a pressurized air tank, is coupled to the air supply connection device 117 via an air hose 710. When the air source is connected to the air supply connection device 117 and forces air through the pump 140, the pump 140 performs its pumping action. The air pressure is regulated as necessary by operating the air pressure regulator operating device 118, and the pump 140 circulates the cleaning medium, which has preferably been heated as described above, through the filter 120 and the oxygen line 600.

After cleaning medium has been circulated through the oxygen line 600, the pump 140 may be stopped by, for example, disconnecting the air hose 710 from the air supply connection device. The connection hose 222 may then be disconnected from the pump inlet connection device 113, and the oxygen line 600, or the connection hose 610, may be disconnected from the cleaning medium filter inlet connection device 111. The oxygen line 600 and/or the connection hose 610 may then be drained into a waste container 400. A relatively small amount of flush medium, such as distilled water or the like, may then be passed through the pump 140, the oxygen line 600 and the connection hose 610 to flush out any remaining cleaning medium. The flush medium may be forced through the pump 140, the oxygen line 600 and the connection hose 610 by, for example, actuating the pump 140, either automatically or by hand, for several cycles. For example, four pump cycles or more is sufficient for flushing.

This flushing step is beneficial because it prevents the rinse medium, described below, from becoming contaminated by cleaning medium remaining in the pump 140, oxygen line 600 and/or the connection hose 610. Moreover, since the cleaning medium is environmentally safe, it may be easily disposed of by pouring down a sink drain or the like.

After the above-described flushing operation, the oxygen line 600, or connection hose 610, is connected to the rinse medium filter inlet connection device 115. Furthermore, a rinse medium tank 300 is connected to the oxygen line cleaning apparatus 100 by connecting a tank inlet 310 of the rinse medium tank 300 to the rinse medium filter outlet connection device 116 via a connection hose (not shown) and connecting a tank outlet 320 of the rinse medium tank 300 to the pump inlet connection device 113. Additionally, the free end of the connection hose 612 connected to the oxygen line 600 is coupled to the rinse medium filter inlet connection device 115. The pump 140 is then operated as described above, thus circulating rinse medium through the oxygen line 600.

The rinse medium is preferably distilled water. Other known or laterdeveloped rinse mediums may be used, provided that they do not adversely affect the operation or function of other components or processes of the system. For example, when a pH-based method is used for determining purity of the oxygen line, as described below, the rinse medium should be a medium that does not affect the pH reading. Distilled water does affect the pH reading, and thus is one example of a suitable rinse medium. Furthermore, it should be appreciated that the rinse medium may be the same as the above-described flush medium.

As with the cleaning medium, the rinse medium is preferably heated. Thus, like the cleaning medium tank 200, the rinse medium tank 300 preferably includes a heating device (not shown). Also, like the cleaning medium tank 200, the rinse medium tank 300 preferably has a capacity of two gallons or more, but preferably not larger than about fifty-five gallons, and more preferably not larger than about ten gallons, and even more preferably not larger than about five gallons. The rinse medium may be heated to about the same temperature as the cleaning medium. Heating the rinse medium increases the rinsing effectiveness of the rinse medium, and also avoids thermal stresses on components of the oxygen line cleaning system that would occur if the cleaning medium and the rinse medium were at different temperatures.

A pH meter 500 or the like is provided to assess the purity of the oxygen line 600 by measuring the pH of the cleaning medium. This may, for example, be done by testing the pH of the cleaning solution before and after circulating the cleaning solution through the oxygen line 600, and determining whether the pH is within a specified range and/or whether the pH has, during the course of being circulated, changed by less than a specified level. The pH alternatively may be measured by, for example, using litmus paper.

Figure 5:
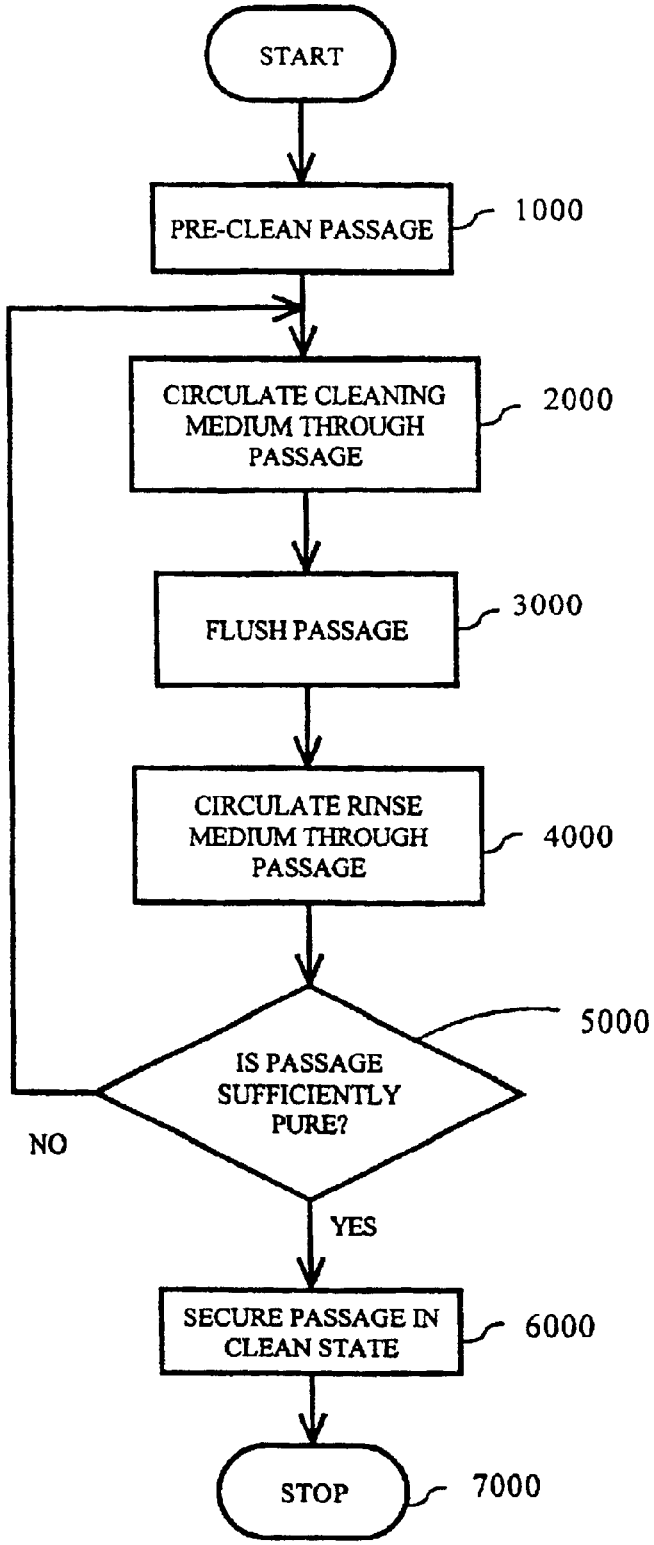
FIG. 5 shows a flowchart of an exemplary process of cleaning a passage.

FIG. 5 shows a flowchart of an exemplary process of cleaning a passage. In step 1000, if necessary, a pre-cleaning process (described in more detail below) is performed to the passage, which may, for example, be or include an oxygen line. Next, in step 2000, a cleaning medium is circulated through the passage. Preferably, circulation of the cleaning medium through the passage continues for about fifteen minutes or more. Then, in step 3000, the passage is flushed with a flush medium.

Continuing to step 4000, a rinse medium is circulated through the passage. Preferably, prior to circulation, purity of the rinse medium is obtained by, for example, measuring the pH of the rinse medium. This pre-circulation purity value may (1) indicate whether the rinse medium is acceptable and (2) may be used as a basis for comparison when making a final purity determination, described below. Circulation of the rinse medium preferably continues for about fifteen minutes or more.

Next, in step 5000, it is determined whether the passage is sufficiently pure. This determination may, for example, be based upon the pH of rinse medium. For example, when the pre-circulation pH is within a specified range, such as about 6.5 to about 8.0, and the post-circulation pH has not changed by more than a level of about 0.3 compared to the pre-circulation pH, it may be determined that the passage is sufficiently pure.

Although a pH-based purity determination method is described above, other known or later-developed purity determination methods, pH-based or otherwise, may be used within the spirit and scope of this invention.

If it is determined in step 5000 that the passage is sufficiently pure, the process continues to step 6000. Otherwise, the process returns to step 2000 and steps 2000–5000 are repeated. If necessary, a reservoir holding the cleaning medium, a reservoir holding the flush medium and/or a reservoir holding the rinse medium are cleaned.

In step 6000, the passage is secured in its purified state by, for example, draining the passage of rinse medium, drying the passage by, for example, blowing an inert gas such as oil-free nitrogen or the like through the passage, and, if desired or necessary, sealing the passage by placing it in a sealable container, such as a plastic bag or the like, or capping its ends. For example, if the passage is or includes an oxygen line that is to be stored or transported to a different location, rather than being immediately reinstalled on an aircraft, for example, the passage should be sealed. Finally, in step 7000, the process ends.

Figure 6:
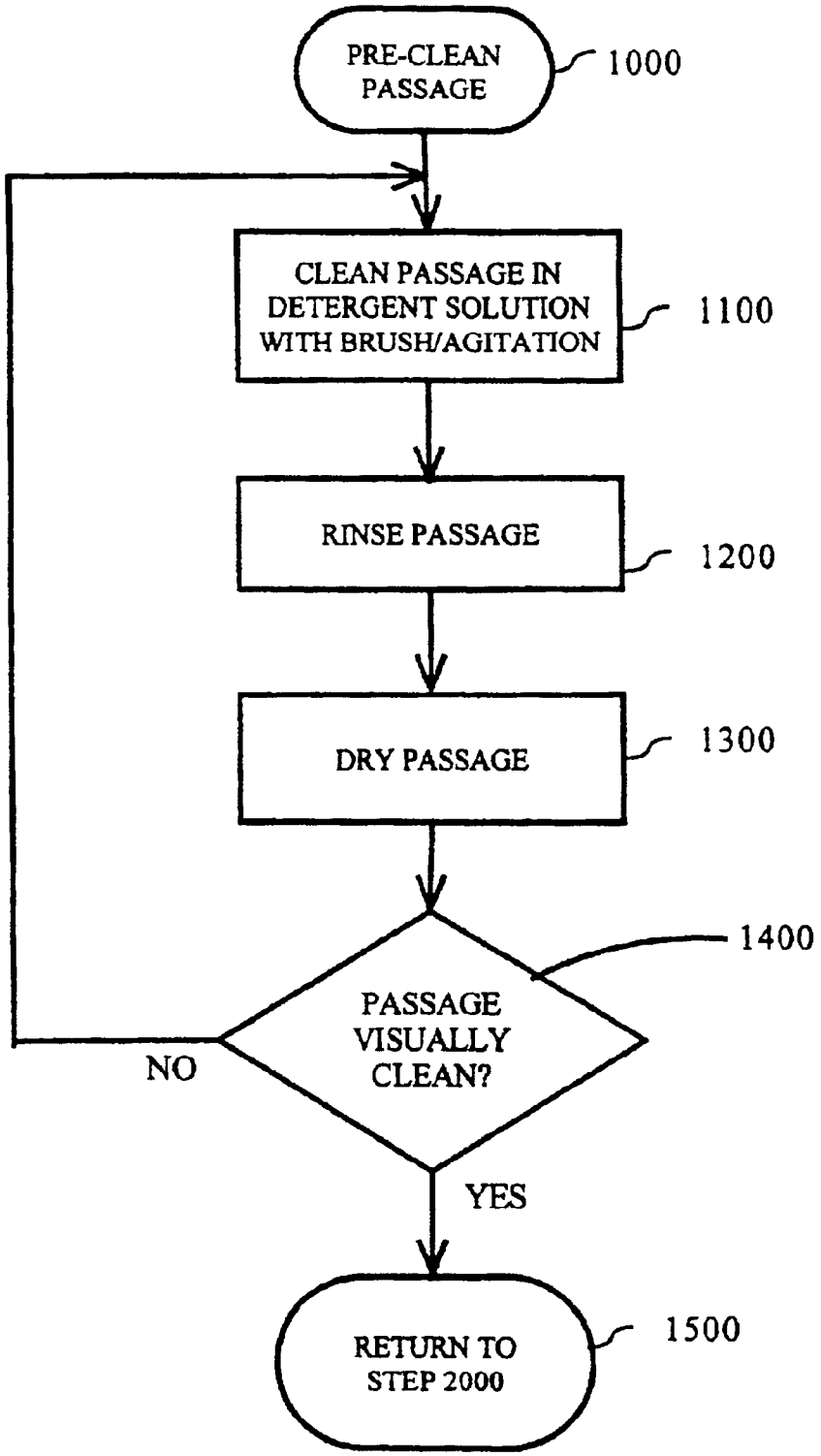
FIG. 6 shows a flowchart of an exemplary process of pre-cleaning a passage.

FIG. 6 shows a flowchart of an exemplary process of pre-cleaning a passage. Beginning in step 1000, the process continues to step 1100, where the passage is cleaned with a detergent solution, preferably including a non-ionic detergent. An example of a suitable non-ionic detergent is known as MIL-D-16791 Type 1. This detergent may be diluted with, for example, distilled water. The passage is preferably cleaned in the solution with the assistance of a brush and/or agitation.

Next, in step 1200, the passage is rinsed with a rinse medium, such as distilled water. Then, in step 1300, the passage may be blown dry by inert gas such as oil-free nitrogen or the like. Continuing to step 1400, the passage is visually inspected for contamination. If the passage is not visually clean, the process returns to step 1100 and steps 1100–1400 are repeated. Otherwise, the process continues to step 1500 and returns to step 2000 of FIG. 5.

Figure 7:
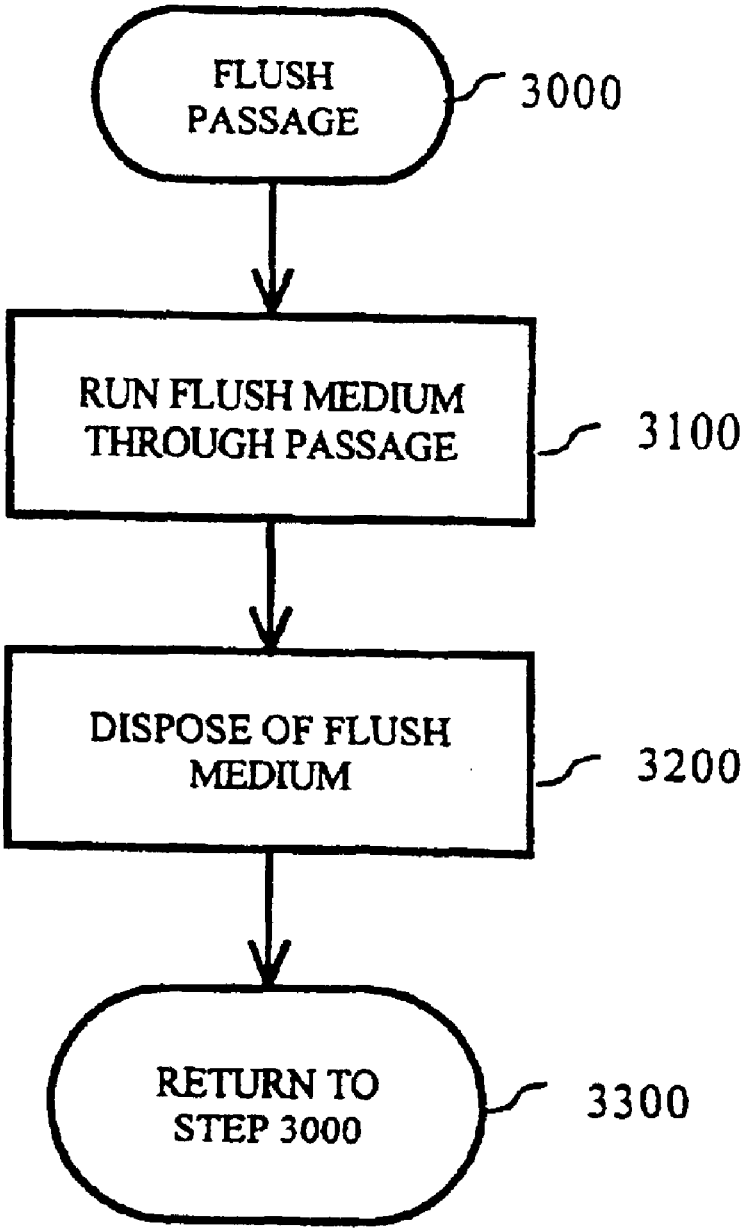
FIG. 7 shows a flowchart of an exemplary process of flushing a passage.

FIG. 7 shows a flowchart of an exemplary process of flushing a passage. Beginning, in step 3000, the process continues to step 3100, where a flush medium is run through the passage. Next, in step 3200, the flush medium is disposed of. Finally, in step 3300, the process returns to step 4000.

While the invention has been described in conjunction with the specific embodiments described above, many equivalent alternatives, modifications and variations will become apparent to those skilled in the art once given this disclosure. Accordingly, the exemplary embodiments of the invention as set forth above are considered to be illustrative and not limiting. Various changes to the described embodiments may be made without departing from the spirit and scope of the invention.

For example, in the above-described embodiments, a single pump 140 circulates both the cleaning medium and the rinse medium. However, if desired, separate pumps may be provided for the cleaning medium and the rinse medium. This would be disadvantageous in terms of size and weight of the apparatus, but may provide advantages that compensate for the increased weight. For example, if separate pumps are provided and a Y-valve is provided at one end of the oxygen line 600, with opposite sides of the "Y" connected to respective pump outlets, and a 3-way valve is provided at the other end of the oxygen line 600, with two outlets connected respectively to the cleaning medium filter 120 and the rinse medium filter 130 and a third outlet emptying into the waste container 400, then the oxygen line 600 may be cleaned and rinsed by operating the pumps and valves as appropriate, without disconnecting the oxygen line 600 from the oxygen line cleaning apparatus 100.

Additionally, although an oxygen line was described as an example of a passage that may be cleaned using the above-described embodiments, this invention may be used to clean other types of passages, such as valves, fittings, and attachments.

What is claimed is:

1. A method for cleaning an oxygen line, comprising the steps of;

connecting a pump having a pump inlet and a pump outlet to pump inlet and pump outlet connection devices, respectively, within a portable unit;

connecting a cleaning medium filter having a filter inlet and a filter outlet to filter inlet and filter outlet connection devices, respectively, within said portable unit;

connecting the pump inlet connection device to a reservoir of a silicated alkaline cleaning medium;

connecting a first part of an oxygen line to be cleaned to the pump outlet connection device;

connecting a second part of an oxygen line to be cleaned to the filter inlet connection device;

connecting the filter outlet connection device to the reservoir of the silicated alkaline cleaning medium; and driving the pump to circulate the silicated alkaline cleaner from the reservoir through the oxygen line to be cleaned, through the filter and back to the reservoir.

2. A method of cleaning an oxygen line according to claim 1, further including rinsing the oxygen line to be cleaned, by performing the following steps:

connecting a rinse medium filter having a rinse medium filter inlet and a rinse medium filter outlet to rinse medium filter inlet and rinse medium filter outlet connection devices, respectively, within said portable unit; and connecting the pump inlet connection device to a reservoir of a rinse medium;

connecting a first part of an oxygen line to the pump outlet connection device;

connecting a second part of an oxygen line to the rinse medium filter inlet connection device;

connecting the rinse medium filter outlet connection device to the reservoir of the rinse medium; and driving the pump to circulate the rinse medium from the rinse medium reservoir through the oxygen line, through the rinse medium filter and back to the reservoir.

3. A method of cleaning an oxygen line according to claim 1, further including the step of connecting said pump to an air inlet connection device within said unit, said pump being an air powered pump, and in said step of driving said pump, supplying air through said air inlet connection device to drive said pump.

4. A method of cleaning an oxygen line according to claim 2, further including providing distilled water as the rinse medium.

* * * * *